United States Patent [19]

Wolfe, Jr.

[11] Patent Number: 4,518,651

[45] Date of Patent: May 21, 1985

[54] MICROWAVE ABSORBER

[75] Inventor: William R. Wolfe, Jr., Wilmington, Del.

[73] Assignee: E. I. Du Pont de Nemours and Company, Wilmington, Del.

[21] Appl. No.: 466,939

[22] Filed: Feb. 16, 1983

[51] Int. Cl.[3] ..... B65B 25/22; B65D 81/34

[52] U.S. Cl. ..... 428/308.8; 99/451; 99/DIG. 14; 156/309.6; 156/309.9; 219/10.55 E; 220/456; 220/458; 229/3.5 R; 229/87 F; 426/107; 426/127; 426/234; 426/243; 427/361; 427/366; 427/370; 427/375; 428/319.7; 428/481

[58] Field of Search ..... 426/127, 107, 234, 243; 99/451, DIG. 14; 219/10.55 E; 229/3.5 R, 87 F; 427/361, 366, 370, 375, 121, 122; 156/309.6, 309.9; 428/308.8, 319.7, 481; 220/456, 458

[56] References Cited

U.S. PATENT DOCUMENTS

| | | | |
|---|---|---|---|
| 4,144,435 | 3/1979 | Clark et al. | 219/10.55 |
| 4,144,438 | 3/1979 | Gelman et al. | 219/10.55 |
| 4,190,757 | 2/1980 | Turpin et al. | 219/10.55 |
| 4,196,331 | 4/1980 | Levickis et al. | 219/10.55 |
| 4,204,336 | 5/1980 | Le Viet | 34/5 |
| 4,230,924 | 10/1980 | Brastad et al. | 219/10.55 |
| 4,237,441 | 12/1980 | van Konyenburg et al. | 338/22 |
| 4,264,668 | 4/1981 | Balla | 428/195 |
| 4,267,420 | 5/1981 | Brastad | 219/10.55 |
| 4,304,987 | 12/1981 | van Konyenburg | 219/553 |
| 4,391,833 | 7/1983 | Self et al. | 426/127 |

FOREIGN PATENT DOCUMENTS

| | | |
|---|---|---|
| 0000797 | 12/1979 | European Pat. Off. . |
| 3010189 | 10/1980 | Fed. Rep. of Germany . |
| 55-104648 | 8/1980 | Japan . |
| 2022977A | 12/1979 | United Kingdom . |
| 2046060A | 11/1980 | United Kingdom . |
| 1595198 | 8/1981 | United Kingdom . |

*Primary Examiner*—James C. Cannon

[57] ABSTRACT

A flexible composite material is disclosed which exhibits a controlled absorption of microwave energy based on presence of particulate carbon in a polymeric matrix bound to a porous substrate. The material is used in packages for microwave cooking. A process for making the material is also disclosed.

8 Claims, No Drawings

MICROWAVE ABSORBER

BACKGROUND OF THE INVENTION

Food preparation and cooking by means of microwave energy has, in the past few years, become widely practiced as convenient and energy efficient. Microwave ovens have the capability to quickly and thoroughly heat any food which has some degree of internal moisture. Because the heating occurs as a result of energy absorption by moisture and fat, heating is accomplished throughout the mass of a food item rather than from the outside to the inside as is the case with traditional cooking methods.

Traditional cooking methods, which involve heat transfer from the outside to the inside of a food item, cause a browning or crispening of the outside surface of the item. One significant, identified, drawback of microwave cooking methods resides in the fact that microwave cooking does not result in a browning or crispening of the surface of a cooked food item. To alleviate the problem, manufacturers of microwave ovens have proposed building traditional infrared elements into the ovens as "browning elements". There are, also, offered cooking vessels which are made to, themselves, absorb microwave radiation and become hot enough to sear and brown the surface of food items which come into contact with the vessels.

Also, there have been packaging or wrapping materials which are designed for use in contact with or near to food items to be cooked and browned by microwave radiation. Those materials are made to absorb microwave radiation and generate enough local heat to brown the surface of nearby food items. Unfortunately, those materials tend to arc and burn through when under microwave radiation adequate to cook food and out of contact with a solid which can serve as a heat sink. Such burn through is unesthetic and, possibly, hazardous.

SUMMARY OF THE INVENTION

According to this invention, there is provided a composite material made to generate heat by absorption of microwave energy. A preferred composite material is made to exhibit a decreased absorption of microwave energy with an increase in temperature. More specifically, the composite material of this invention absorbs less microwave energy as the temperature of the material is increased over at least a part of the temperature range from 50°–250° C. The composite material comprises a porous, dielectric, substrate substantially transparent to microwave radiation and an electrically conductive coating on one surface of the substrate comprising electrically conductive particles in a thermoplastic dielectric matrix. At least some of the matrix is beneath the surface of the substrate and is substantially free of electrically conductive particles. If desired or required, the composite can have a protective layer adhered to the electrically conductive coating so long as the protective layer is substantially transparent to microwave radiation.

According to this invention, there is, also, provided a process for manufacturing the above-described composite material. The process comprises applying a coating of a dispersion of finely-divided electrically conductive particles in a thermoplastic dielectric matrix to a porous, dielectric, substrate, heating the coating and the substrate to a temperature above the softening point of the matrix and pressing the heated coating against the porous substrate at a pressure of from 600 to 8700 kilopascals for from 0.03 to 200 seconds.

DETAILED DESCRIPTION OF THE INVENTION

The composite material of this invention includes a porous dielectric substrate component coated with a thermoplastic dielectric matrix component which contains a particulate electrically conductive material component combined in a way to generate heat upon exposure to microwave radiation. The composite material does not arc or burn-through and is useful in packaging as a microwave heating element.

The components of the composite material are combined by dispersing a particulate electrical conductor in a thermoplastic matrix, applying the dispersion to a porous dielectric substrate, and forcing the matrix of the dispersion, using laminating pressures, temperatures, and times, into combination with the substrate. The composite material of this invention requires all three of the components. No one or two of the components, alone, can be used to generate heat acceptably by exposure to microwave generation; and, in fact, the three components must be combined in a particular way to achieve acceptable results.

It should be noted that the composite material of this invention has, in some aspects, the appearance of a laminate. The composite material of this invention, however, includes a particular intermingling of substrate and matrix polymer and can be made by means other than by laminating individual layers together. The words "composite material" will, therefore, be used herein to describe the structure of this invention and will be taken to include any laminate-like structures which fall within the description.

The porous substrate is a sheet or web material, usually paper or paperboard. It is important that the substrate be a dielectric and that it be porous and substantially transparent to microwave radiation. If the substrate is paper or paperboard, the side which receives the electrically conductive coating must not be coated or, if coated, the coating must be porous, nevertheless. An acceptable paper coating is usually clay or sizing or some decorative ink or lacquer which may reduce the porosity of the substrate but not eliminate it altogether. Other porous dielectric materials can be used as substrates as long as they maintain sufficient rigidity and an adequate dimensional stability at temperatures up to about 250° C. or higher.

The electrically conductive coating on the substrate comprises a matrix of thermoplastic, dielectric, material with finely-divided conductive particles dispersed therein. The matrix can be any of a variety of polymeric materials such as polyesters, polyester copolymers, ethylene copolymers, polyvinyl alcohol, and the like. Polyester copolymers are preferred. Either amorphous or crystalline matrix polymer can be used in this invention. It is believed that the presence of the porous substrate provides rigidity and dimensional stability to the composite structure; and that the intermingling of the matrix polymer with the surface of the porous substrate provides physical control of the spacing between conductive particles. It is believed that the application of laminating pressures, temperatures, and times causes the electrically conductive particles to become concentrated at the surface of the structure in a close-packed configuration not possible by mere coating procedures.

The conductive particles can be any material which has a conductivity adequate to exhibit a surface resistivity of less than about 1000 ohms/square in a solid dispersion coating about 2–10 microns thick with a particle concentration in a dielectric matrix polymer of less than about 60 weight percent. Eligible materials include carbon black in the form of lampblack, furnace black, channel black, and graphite. Lampblack and furnace black are preferred. The surface area of conductive carbon particles, in bulk, is believed to be important. The surface area for eligible carbon materials appears to be about 20–240 square meters per gram. Carbon particles having higher surface area have a tendency to spark in microwave radiation. Particle size for the conductive particles can be from 15 to 100 nanometers.

One procedure which has been used to determine whether or not a particular electrically conductive material is useful in this invention, involves making dispersions of the material at several concentrations in matrix polymer, casting coatings of the dispersions, and determining surface resistivities of the cast coatings. Such is termed the "Surface Resistivity Test". The dispersions are prepared in the same way and using the same materials as is described hereinafter in Example 1 for preparing a coating composition. For the Surface Resistivity Test, the dispersions are made at concentrations of 65, 90, 110, and 135 weight parts of particulate material per hundred weight parts of matrix polymer; and they are cast into films about 8–10 microns thick when dry. The surface resistivity of each film is measured. A surface resistivity of 100 to 1000 ohms per square indicates usefulness in the composite of this invention and 250 to 750 ohms per square is preferred. Optimum concentrations can be determined by interpolation of the surface resistivity measurements from the several films prepared. The concentration of material which exhibits the desired conductance in the above procedure is the concentration to be used in manufacture of the composite of this invention. The preferred concentration for lampblack has been found to be from 110 to 135 parts per hundred parts of matrix polymer. It has been found that dry dispersion films should have from 25 to 60 weight percent conductive material and from 40 to 75 weight percent matrix polymer for best microwave heat generation.

In preparation of a liquid dispersion of a matrix polymer and conductive particles, care should be used to dissolve the matrix polymer completely and to disperse the conductive particles uniformly. Because the dispersion includes matrix polymer in a concentration of 10 to 25 weight percent and because it is desirable to have a coating dispersion of low viscosity, a good solvent for the matrix polymer should be chosen. For example, when a polyester copolymer is the matrix polymer, tetrahydrofuran, methylene chloride, or trichloroethane can generally be used as solvents.

Conductive particles are dispersed into a solution of matrix polymer by any of several means well known in this art. For example, the dispersions can be ball milled, or made in a high shear mixer. If it is desired or required to achieve an exceptionally uniform dispersion, surface active agents or dispersion aids can be added in the amounts usually used for making dispersions of such materials.

The composites of this invention are preferably made by coating a liquid dispersion of electrically conductive particles in a solution of matrix polymer onto a carrier film and evaporating the solvent to leave the carrier film with a dried, solid, dispersion of conductive particles and matrix polymer coated thereon. The composite of this invention is made by pressing the coated side of the carrier film to a porous substrate, heating the dried coating to soften the matrix polymer and subjecting the heated coating to a pressure adequate to force some of the matrix polymer into the porous substrate. The composites can also be made by coating the liquid disperion directly onto the porous substrate and then evaporating the solvent and heating the coating and subjecting it to pressure; as described above. It is believed that the steps of heating and pressing have the effect of intermingling the matrix polymer with the porous substrate beneath the surface of the substrate. It is believed that the substrate acts as a barrier to movement of the electrically conductive particles; and that, when the matrix polymer is forced beneath the surface of the substrate, the coating remaining above the surface is physically anchored and the concentration of conductive particles in the coating above the surface is increased.

The carrier film, when used as described above, supports the coated dispersion prior to making the composite and, also serves as a protective layer in the composite material of this invention. As a protective layer, it protects the coated dispersion from handling and abrading forces during manufacture and use of the composite material. The terms "carrier film" and "protective layer" refer to the same element of the composite material and, to avoid confusion, only the term "protective layer" will be used hereafter. The protective layer can be porous and can be paperboard or any material which is also useful as a substrate. The protective layer can also be nonporous and is usually a polymeric film. The protective layer is preferably biaxially-oriented polyethylene terephthalate film but other polyethylene terephthalate film can be used and other polyesters and film of other polymers, such as polyamides, polyimides and the like are also eligible.

Process conditions for manufacturing the composite material of this invention vary depending upon, among other things, the matrix polymer and the porosity of the substrate. Those conditions can be easily determined by means of simple tests. It has been found that most matrix polymers and porous substrates operate well at temperatures above the softening point of the matrix polymer at pressures of more than 600 to 8700 kilopascals for 0.03 to 200 seconds. Upper temperature limits are generally limited by the degradation temperature of the matrix polymer or the distortion temperature of the substrate, or of the protective layer, if one is present. A practical upper temperature limit is usually considered to be about 225° C. Specific conditions will be described in the examples below.

One procedure which has been used to determine whether or not a particular combination of process conditions is satisfactory for practice of this invention, involves preparing test laminates, exposing them to microwave radiation and determining the rise in temperature caused by the microwave radiation on the test laminates as compared with the rise in temperature of unlaminated samples of the same materials exposed to the same microwave radiation. Such is, hereafter, termed the "Heating Differential Test". The temperature rise of the test laminate less the temperature rise of the unlaminated material equals the Temperature Differential. The Temperature Differential divided by the temperature rise of the test laminate times 100 equals the Percentage Temperature Differential for the test laminate. Test laminates which exhibit a Percentage Temperature Differential of 15 or more under conditions of the Heating Differential Test represent the composite materials of this invention; and the process conditions under which such composite materials have been made represent a proper combination of process conditions within the practice of this invention; provided that the individual values for temperature, pressure, and time are within the ranges set out in the preceding paragraph.

The Heating Differential Test is conducted by exposing a laminated combination of electrically conductive coating and porous substrate material to microwave radiation. The electrically conductive coating is made by casting a dispersion of electrically conductive particles in a matrix polymer solution onto a protective layer which is substantially transparent to microwave radiation. The resultant coating, with a thickness of 2–10 microns and a concentration of electrically conductive particles adjusted to exhibit values of 100 to 1000 ohms per square in the Surface Resistivity Test, is pressed into a porous substrate using temperatures, pressures, and times within the ranges set out above as process conditions for practice of the invention.

For performing the Heating Differential Test, the recommended matrix polymer is a polyester copolymer formed by reaction of a mixture of 0.53 mol of terephthalic acid and 0.47 mol of azelaic acid with 1.0 mol of ethylene glycol, the recommended substrate is 18 point plain paperboard identified as Solid Bleached Sulfite (SBS) paperboard, and the recommended protective layer is biaxially oriented polyethylene terephthalate film 12 microns thick.

Laminates made for the Heating Differential Test are placed between quartz plates 0.32 centimeter thick and are exposed to microwave radiation in an oven having an output power of about 550 watts at a frequency of 2.45 gigahertz for 45 seconds. The initial temperature of the oven cavity should be about 25° C. Unlaminated samples of the same materials are prepared by adhering the coated protective layer to the substrate material by means of a double-sided adhesive tape. The coated protective layer must be mounted onto the substrate to maintain a structural integrity through testing. The unlaminated sample is mounted between quartz plates and exposed, as above-described, and the rise in temperature of the unlaminated sample is recorded. Calculation of the Percentage Temperature Differential is conducted as described above.

Insofar as use of composite materials to cook food is concerned, it is preferred that the composite materials be such that food in contact with a composite material will attain a temperature of from 175° to 235° C. for a duration of one minute after two minutes of microwave exposure.

DESCRIPTION OF PREFERRED EMBODIMENTS

EXAMPLE 1

This example shows the microwave heating qualities of composites of this invention compared with untreated, self-supported films having a corresponding concentration of electrically conductive particles.

In this example, the substrate was 18 point plain paperboard identified as Solid Bleached Sulfite (SBS) paperboard. The electrically conductive particles were carbon black exhibiting a surface area of 25 square meters per gram and a particle size of 75 nanometers, as sold by Cabot Corporation under the designation "Sterling R". The matrix polymer was a polyester condensation copolymer formed by reaction of a mixture of 0.53 mol of terephthalic acid and 0.47 mol of azelaic acid with 1.0 mol of ethylene glycol. The matrix polymer exhibited a softening point of 140°–155° C.

To prepare a coating composition, 7 weight parts of the carbon black was dispersed in 14 weight parts of the matrix polymer dissolved in 80 weight parts of 1,1,2-trichloroethane by mixing in a high speed blender for 20 seconds.

The coating composition was applied to sheets of the paperboard by means of a coating knife to a wet film thickness of about 0.05 millimeters and was allowed to dry.

Biaxially oriented polyethylene terephthalate film 12 microns thick as a protective layer was laid over some of the dried coating composition and a composite material was made by application of pressure and heat. The composite material was made by pressing the dried coating composition against the paperboard substrate at a pressure of 8620 kilopascals (1250 psi) for three minutes at 190° C.

Samples of the coated composition, both pressed, as the composite of this invention, and unpressed as a comparative material, were placed between quartz plates 0.32 centimeter ($\frac{1}{8}$ inch) thick, as a heat sink, and were exposed in an oven to microwave radiation in a Heating Differential Test. The oven had an output power of about 550 watts at a frequency of 2.45 gigahertz and the exposure was for a total of 150 seconds. The temperature of the composite sample rose to 148° C. after 45 seconds, 201° C. after 90 seconds, and 227° C. after 150 seconds. The temperature of the comparative material sample did not rise above 60° C. after exposure for 90 seconds to microwave radiation from the same oven.

The Percentage Temperature Differential for the composite material of this example is greater than 70.

EXAMPLE 2

This example shows the importance of pressure in making the composite material of this invention.

The coating composition was the same as the coating composition of Example 1 except that 9.5 weight parts of the carbon black were used. The coating composition was applied to 12 micron-thick, biaxially oriented, polyethylene terephthalate protective layer by means of a coating knife to a wet film thickness of about 0.05 millimeters and the solvent was evaporated.

Samples of the so-coated polyethylene terephthalate film were pressed against 18 point SBS paperboard at 190° C. at different pressures for three minutes each. The resulting materials were exposed in a Heating Differential Test as in Example 1 and the temperatures of the materials were recorded after 45,90, and 150 seconds of microwave exposure. Results of the heating test are set out below in Table I.

TABLE I

| Pressure (k Pascals) | Temperature (°C.) after microwave exposure for - | | |
|---|---|---|---|
| | 45 sec. | 90 sec. | 150 sec. |
| 1035 (150 psi) | 98 | 117 | 132 |
| 2140 (310 psi) | 132 | 175 | 217 |
| 3210 (465 psi) | 127 | 172 | 216 |

TABLE I-continued

| Pressure (k Pascals) | Temperature (°C.) after microwave exposure for - 45 sec. | 90 sec. | 150 sec. |
|---|---|---|---|
| 4310 (625 psi) | 137 | 190 | 226 |
| 5380 (780 psi) | 168 | 219 | 240 |
| 6480 (940 psi) | 159 | 214 | 236 |
| 7750 (1124 psi) | 164 | 217 | 240 |
| 8620 (1250 psi) | 164 | 217 | 240 |

The temperature of unpressed samples of the coated composition of this example did not rise above 60° C. after exposure for 90 seconds to the same microwave radiation.

The Percentage Temperature Differential for the composite material of this example made at the lowest pressure is greater than 50. All composite materials made at higher pressures exhibited higher Percentage Temperature Differentials.

EXAMPLE 3

This example shows the importance of the duration of the heating and pressing steps in making the composite material of this invention.

The coated protective layer was made using the same materials and procedures as described in Example 2, above, and the same paperboard was used as the porous substrate. Samples of the coated film were pressed against the paperboard at 190° C. and at 8620 kilopascals (1250 psi): some samples for a duration of 12 seconds, and some samples for a duration of 3 minutes.

In a Heating Differential Test, the temperature of samples of the material pressed for only 12 seconds rose to 114° C. after 45 seconds of microwave exposure of the same intensity as was used in the previous examples; and the temperature rose to 144° C. after 90 seconds of exposure. The temperature of the material which was pressed for 3 minutes rose to 163° C. and 217° C. under the same radiation for 45 and 90 seconds, respectively. The temperature of samples of unpressed samples of the material did not rise above 60° C. after 90 seconds of exposure.

The Percentage Temperature Differential for the composite material of this example pressed for 12 seconds is greater than 60. Composite materials pressed for longer times exhibited higher Percentage Temperature Differentials.

EXAMPLE 4

This example shows the importance of the temperature in the heating and pressing steps in making the composite material of this invention.

The coated protective layer was made using the same materials and procedures as described in Example 2, above, and the same paperboard was used as the porous substrate. Samples of the coated film were pressed against the paperboard at 7170 kilopascals (1040 psi) for 3 minutes at various temperatures.

The resulting materials were exposed in a Heating Differential Test as in Example 1 and the temperatures of the materials were recorded after 45, 90 and 150 seconds of microwave exposure. Results of those heating tests are set out below in Table II.

TABLE II

| Composite Manufacturing Temperature (°C.) | Temperature (°C.) after microwave exposure for - 45 sec | 90 sec | 150 sec |
|---|---|---|---|
| 150 | 124 | 164 | 204 |
| 160 | 119 | 160 | 207 |
| 170 | 118 | 144 | 178 |
| 180 | 146 | 198 | 226 |

The temperature of unpressed samples of the coated composition of this example did not rise above 60° C. after exposure for 90 seconds to the same microwave radiation.

The Percentage Temperature Differentials for the composite materials of this example pressed at a variety of temperatures were all greater than 65.

EXAMPLE 5

This example shows preparation of a composite material of this invention using a roll mill.

In this example, 472 weight parts of the same carbon black as was used in previous examples was ball-milled in a solution including 453 weight parts of the matrix polymer of Example 1 and 2775 weight parts tetrahydrofuran to yield a uniform dispersion. To prepare a coating composition of 20–40 centipoises, 3200 weight parts of the ball-milled dispersion was diluted with 368 weight parts of toluene and 598 weight parts of tetrahydrofuran.

Samples of the same polyethylene terephthalate protective layer as was used in previous examples were coated with the above-prepared coating composition to produce two different coated-film materials having dried coating weights of 5.3 and 9.0 grams per square meter, respectively.

The two coated film materials were pressed against samples of the same kind of SBS paperboard as was used in previous examples using a conventional nip roll laminator with two nips in line, each exerting a linear force of about 14.3 kilograms per centimeter (80 lbs/inch) and consisting of two rubber rolls on one steel roll heated to 190° C. The line of contact between the rubber roll and the steel roll was estimated to be 0.32 centimeter ($\frac{1}{8}$ inch) wide, amounting to a pressure of about 4415 kilopascals (640 psi). The heating and pressing was conducted at about 0.041 meters per second to provide a pressing time of about 0.16 second.

The two different coated protective layers and the SBS paperboard were also used to make composite materials in a press. The press manufacture was conducted at 6480 kilopascals (940 psi) for 10 seconds at 190° C.

The resulting materials were exposed in a Heating Differential Test, as in Example 1, and the temperatures of the materials were recorded after 45 and 90 seconds of microwave exposure. Results of the heating test are set out below in Table III.

TABLE III

| Coating Wt. ($gm/m^2$) | Exposure time (sec.) | Temperature (°C.) after microwave exposure of- Nip Roll | Pressed | Unpressed |
|---|---|---|---|---|
| 5.3 | 45 | 130 | 207 | 101 |
| | 90 | 172 | 228 | 120 |
| 9.0 | 45 | 154 | 207 | 118 |
| | 90 | 193 | 245 | 170 |

The Percentage Temperature Differentials for the composite materials of this example having the low coating weight were 27 for the nip roll manufacture and 58 for material made in the press. For the composite materials having the high coating weight, the Percentage Temperature Differentials were 27 for the nip roll manufacture and 48 for material made in the press.

EXAMPLE 6

In this example, 436 weight parts of the same carbon black as was used in previous examples was ball-milled in a solution including 329 weight parts of the matrix polymer of Example 1 and 2294 weight parts tetrahydrofuran to yield a uniform dispersion. That dispersion was further diluted with 255 weight parts toluene and 625 weight parts tetrahydrofuran, and the resulting coating composition was coated onto a polyethylene terephthalate protective layer to obtain dried coating weights of 8–10 grams per square meter. Those coated films were pressed against the same SBS paperboard as was used in previous examples using the nip roll laminator of Example 5. The nip roll laminator was adjusted to provide 14.3 kilograms per centimeter linear force at the nips (4415 kilopascals pressure, as determined in Example 5), the temperature of the steel roll was adjusted to be 190° C., and the heating and pressing speed was adjusted to be 0.162 meters per second (32 fpm) to provide a pressing time of 0.04 second.

Samples of the coated protective layer and the SBS paperboard of this example were also used to make composite materials in a press. The press manufacture was conducted at 6480 kilopascals (940 psi) for 10 seconds at 190° C. The resulting materials were exposed in a Heating Differential Test as in Example 1 and the temperatures of the materials were recorded after 45 and 90 seconds of microwave exposure. Results of the heating test are set out below in Table IV.

TABLE IV

| Pressing Method | Temperature (°C.) after microwave exposure for - 45 sec. | 90 sec. |
|---|---|---|
| nip roll | 169 | 244 |
| pressed | 205 | 245 |
| unpressed | 145 | 168 |

The Percentage Temperature Differentials for the composite materials of this example were 17 for the nip roll manufacture and 33 for material made in the press.

EXAMPLE 7

This example shows the operability of an array of different carbon blacks as electrically conductive particles.

Example 1 was repeated with the exceptions that different carbon blacks were used in different amounts, and that a variety of pressing conditions and times were used. Those differences are shown below in Table V, along with the temperatures attained in a Heating Differential Test. Temperatures of the materials were recorded after 45 and 90 seconds of microwave exposure.

TABLE V

| Carbon black | quantity (wt. parts) | Manufacturing pressure time (kP) | (sec) | Temp (°C.) after microwave exp. for - 45 sec. | 90 sec. |
|---|---|---|---|---|---|
| [1]Vulcan P | 13 | 4310 | 120 | 176 | 228 |

TABLE V-continued

| Carbon black | quantity (wt. parts) | Manufacturing pressure time (kP) | (sec) | Temp (°C.) after microwave exp. for - 45 sec. | 90 sec. |
|---|---|---|---|---|---|
| [2]Degussa LB 101 | 13 | 8620 | 10 | 204 | 232 |
| [3]Monarch 880 | 9.5 | 4310 | 120 | 190 | 222 |
| [4]Sterling SO | 9.5 | 4310 | 120 | 180 | 238 |

[1]exhibits a surface area of 140 $m^2/g$, a particle size of 20 nanometers, and is sold by Cabot Carbon Ltd. under the designation "Vulcan P" carbon black.
[2]exhibits a surface area of 20 $m^2/g$, a particle size of 95 nanometers, and is sold by Degussa, Pigments Division, Frankfurt, W. Germany under the designation "Degussa Lamp Black 101".
[3]exhibits a surface area of 220 $m^2/g$, a particle size of 16 nanometers, and is sold by Cabot Corporation under the designation "Monarch 880".
[4]exhibits a surface area of 42 $m^2/g$, a particle size of 41 nanometers, and is sold by Cabot Corporation under the designation "Sterling SO".

The temperature of unpressed samples of the coated compositions of this example did not rise above 60° C. after exposure for 90 seconds to the same microwave radiation.

The smallest Percentage Temperature Differential for the composite materials of this example was greater than 76.

What is claimed is:

1. A composite material for generation of heat by absorption of microwve energy comprising:
   (a) a porous, dielectric, substrate substantially transparent to microwave radiation;
   (b) an electrically conductive coating on one surface of the substrate comprising;
      (i) electrically conductive particles in
      (ii) a thermoplastic dielectric matrix, wherein, at least some of the matrix is beneath the surface of the substrate, is substantially free of electrically conductive particles, and is intermingled with the substrate; and
   (c) a protective layer of polyethylene terephthalate adhered to the electrically conductive coating.

2. A composite material for generation of heat by absorption of microwave energy comprising:
   (a) a porous, dielectric paperboard substrate substantially transparent to microwave radiation;
   (b) a coating on one surface of the substrate comprising:
      (i) 25 to 60 weight percent finely-divided carbon particles in
      (ii) 40 to 75 weight percent thermoplastic dielectric matrix,
      wherein at least some of the matrix is beneath the surface of the substrate, is substantially free of carbon particles, and is intermingled with the substrate; and
   (c) a protective layer of polyethylene terephthalate adhered to the coating.

3. A process for manufacturing a composite material generation of heat by absorption of microwave energy comprising:
   (a) providing a porous, dielectric, substrate substantially transparent to microwave radiation;
   (b) applying to the substrate a coating of a dispersion of finely-divided, electrically conductive, particles in a thermoplastic dielectric matrix;
   (c) heating the coating and the substrate to a temperature above the softening point of the matrix; and
   (d) pressing the heated coating against the substrate at a pressure of 600 to 8700 kilopascals for 0.03 to 200 seconds.

4. The process of claim 3 wherein the coating is applied to the substrate by first coating a liquid dispersion in a solvent onto the substrate and then evaporating the solvent.

5. The process of claim 3 wherein the coating is applied to the substrate by first coating a liquid dispersion in a solvent onto a protective layer and evaporating the solvent and then pressing the coated side of the protective layer to the substrate.

6. The process of claim 5 wherein the protective layer is polyethylene terephthalate.

7. The process of claim 3 wherein the substrate is paper.

8. The process of claim 3 wherein the electrically conductive particles are carbon.

* * * * *